US006401297B1

(12) United States Patent
Huang

(10) Patent No.: US 6,401,297 B1
(45) Date of Patent: Jun. 11, 2002

(54) DOOR LOCK LATCH

(76) Inventor: Mao-Lien Huang, No. 32, Alley778, Hua-Cheng Road, Hsin Chuang City (TW)

( * ) Notice: Subject to any disclaimer, the term of this patent is extended or adjusted under 35 U.S.C. 154(b) by 0 days.

(21) Appl. No.: 09/488,055

(22) Filed: Jan. 20, 2000

(51) Int. Cl.[7] ..... E05B 15/00
(52) U.S. Cl. ..... 16/1.5; 16/169.14; 16/337
(58) Field of Search ..... 292/1.5, 337, DIG. 60

(56) References Cited

U.S. PATENT DOCUMENTS 4,750,766 A * 6/1988 Shen ..... 292/337
5,149,151 A * 9/1992 Shen ..... 292/1.5
5,169,184 A * 12/1992 Bishop ..... 292/1.5
5,257,837 A * 11/1993 Bishop ..... 292/1.5
5,743,573 A * 4/1998 Huang ..... 292/1.5
5,927,770 A * 7/1999 Huang ..... 292/169.14

* cited by examiner

*Primary Examiner*—Anthony Knight
*Assistant Examiner*—Mark Williams
(74) *Attorney, Agent, or Firm*—Jacobson Holman, PLLC

(57) ABSTRACT

A door lock latch, of which the latch body includes a base, an upper cover and a latch fixing plate. The base is provided with a nut cylinder nearby the rear end of the base body thereof. The upper cover is provided with a correspondent tap hole nearby the rear end of the cover body. The latch fixing plate is provided with a flat O-shaped hole for a latch bar at the center of the plate body, and two holes are provided on two sides of the plate body so as to rivet and install a decorative panel on the front of the plate body. After installing a latch opening/closing mechanism and a latch bar between the base and the upper cover, a screw is disposed in the tap hole on the upper cover and the nut cylinder of the base so as to lock and join each other.

1 Claim, 4 Drawing Sheets

DOOR LOCK LATCH

BACKGROUND OF THE INVENTION

The upper edge of a flat O-shaped hole 231 for the latch bar 24 at the center of base fixing plate 23 is provided with a notch 232 so as to install an upper cover 22; a nut cylinder 211 is provided at a position nearby the rear end of base body 210 so as to lock the upper cover 22; or, alternatively, a pair of protuberances are provided correspondingly at the front end of cover body 220 of the upper cover 22 so as to be installed at the notch 232 of latch fixing plate 23 at the front end of base 21; a tap hole 222 is provided correspondingly at a position nearby the rear end of cover body 220 so as to dispose a screw 27 in the nut cylinder 211 on the base body 210 for locking each other.

Since the base body 210 of base 21 of long and short latches 2*a*, 2*b* of conventional door lock is integrally molded together with the latch fixing plate 23 and no "retractable mechanism" is designed to adjust the length of latch, some separate molds have to be made so as to make the latches and upper covers with different length and to install a latch opening/closing mechanism 25 and latch bar 24 between the base 21 and the upper cover 22 (as shown in FIG. 4 and 5), and after a decorative panel 26 in riveted in front of the latch fixing plate 23, the long latch 2*a* and the short latch 2*b* are respectively made for the consumers' optional purchase and installation.

Because the long and short latches 2*a*, 2*b* with specific length have to be made for the conventional door lock latch and no retractable mechanism to adjust the length of long and short latches is provided, frequently the consumers buy the wrong door locks which cannot be installed, and for the manufacturers, they have to produce both long and short latches 2*a*, 2*b* with different length and increase a doubled stock in their warehouse.

For the convenience of consumers' optional purchases without troubles of installation, and also for the convenience of manufacturers' production to decrease one half of their warehouse stock, the present inventor particularly invented "an improved door lock latch" through his research and development.

SUMMARY OF THE INVENTION

The primary object of the present invention is to offer an improved door lock latch which is characterized in convenient installation and use, without identifying long or short one while optional purchase, and even if in case of undesirable length while installation, all to do is to loosen the screw to "pull long" for elongation or "press in" for contraction and then to lock it then the short latch becomes long one or the long latch becomes short one.

Another object of the present invention is to offer an improved door lock latch which is characterized in the convenience of manufacturers' production without separately making both long and short latches, and only one length is made enough to adjust the length of these latches.

Figure 1:
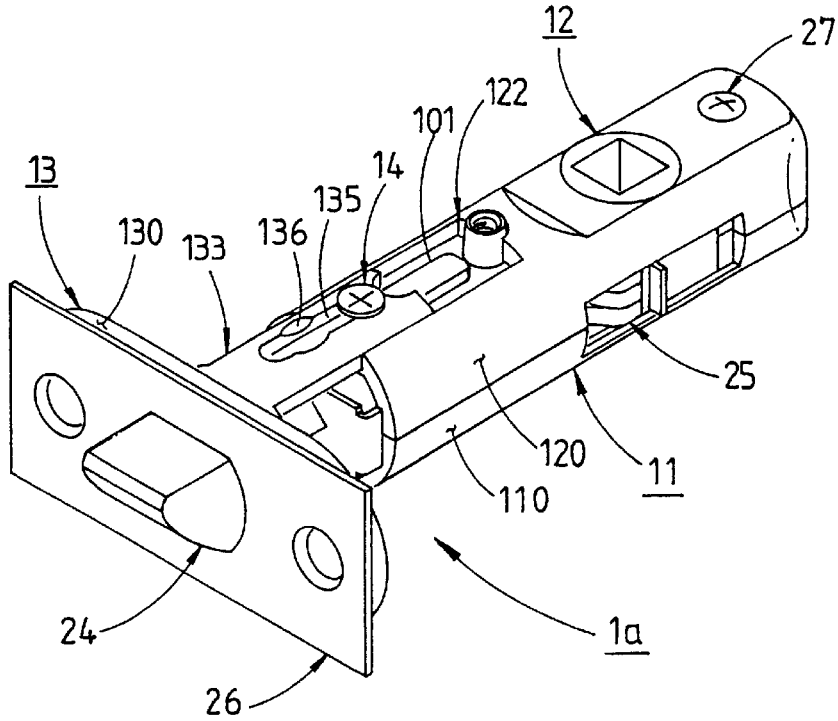
FIG. 1 is an elevation view of the present invention in a state of elongation as a "long latch."

Cross reference numbers:

1*a*. improved long latch of door lock according to the present invention
1*b*. improved long latch of door lock according to the present invention
2*a*. long latch
2*b*. short latch
11. base
12. upper cover
13. latch fixing plate
14. screw
21. base
22. upper cover
23. latch fixing plate
24. latch bar
25. latch opening/closing mechanism
26. decorative panel
27. screw
101. guide track
102. threaded hole
110. base body
111. nut cylinder
112. recess
120. cover body
121. tap hole
122. recess
130. plate body
131. flat O-shaped hole
132. hole
133. fixing piece
134. guide way
135. slot
136. conical indentation
210. base body
211. nut cylinder
220. cover body
221. protuberance
222. tap hole
230. plate body
231. flat O-shaped hole
232. notch

DETAILED DESCRIPTION

Figure 2:
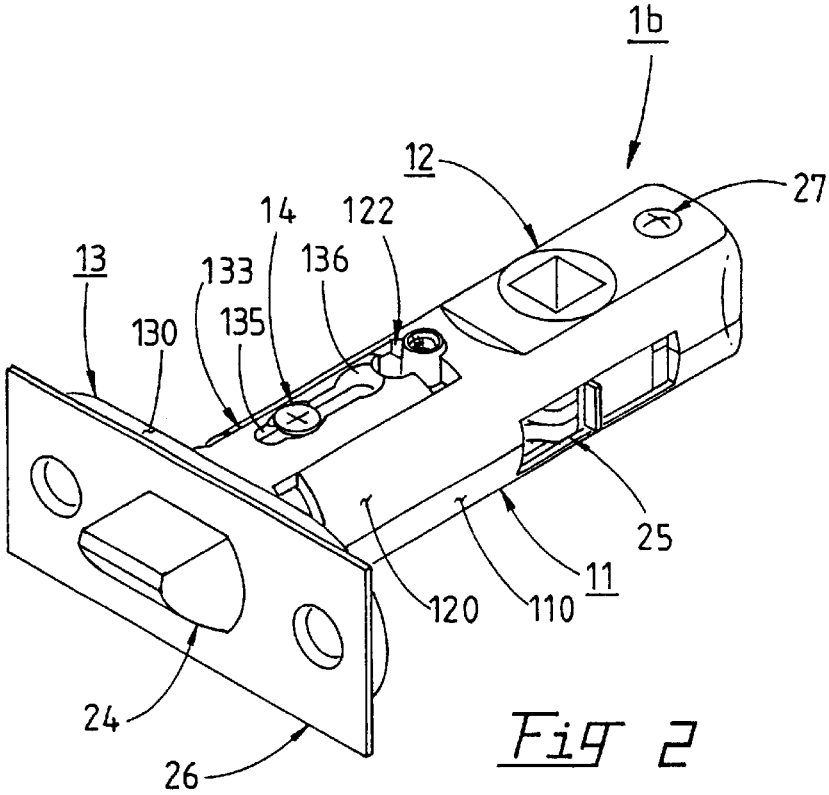
FIG. 2 is an elevation view of the present invention in a state of contraction as a "short latch."
Figure 3:
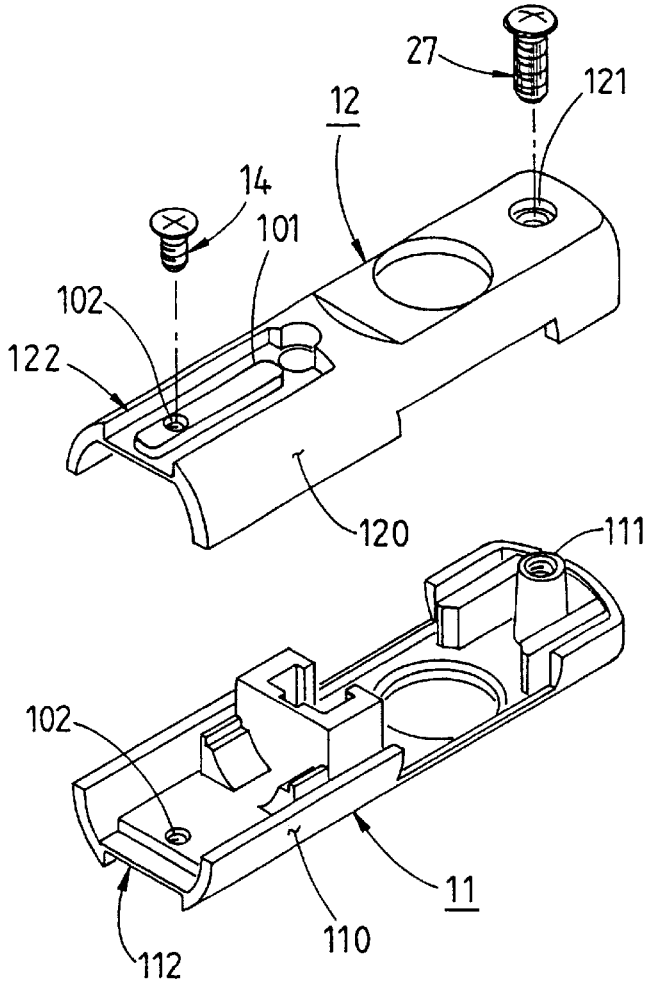
FIG. 3 is an elevation view of the body members of the present invention except the latch bar, latch opening/closing mechanism and decorative panel.
Figure 3:
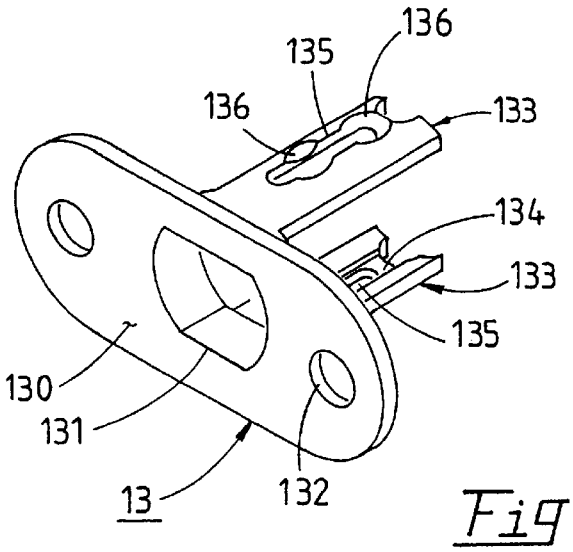
Figure 5:
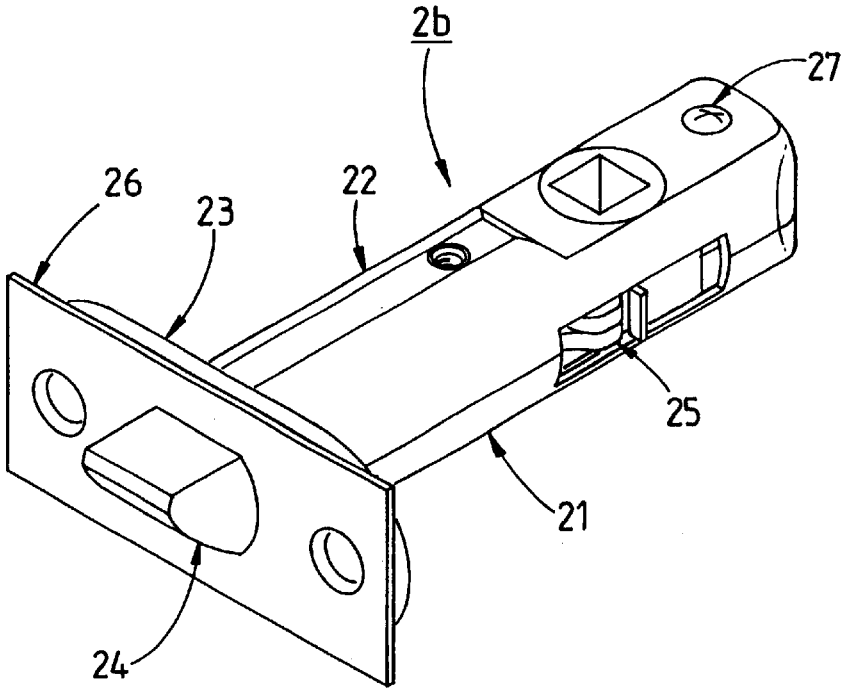
PRIOR ART Fig 5
FIG. 5 is an elevation view of the short latch of conventional door lock.
Figure 4:
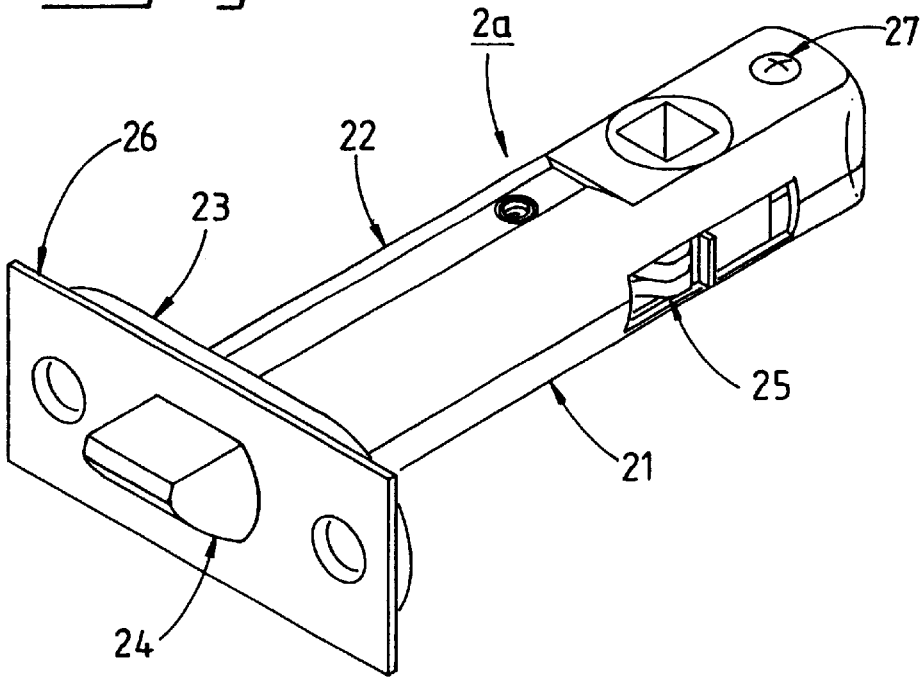
Fig 4 PRIOR ART
FIG. 4 is an elevation view of the long latch of conventional door lock.
Figure 6:
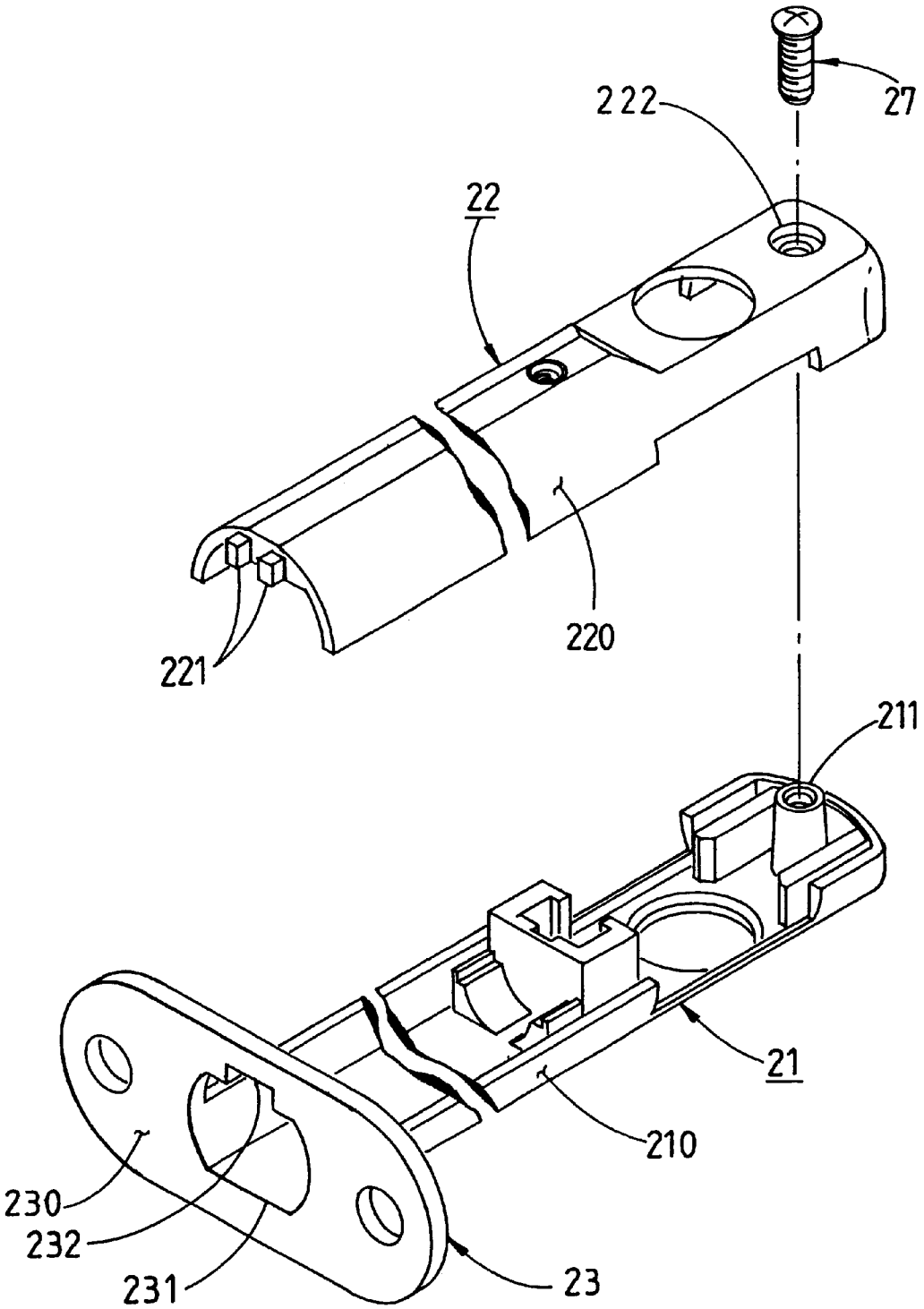
Fig 6 PRIOR ART
FIG. 6 is an elevation breakdown view of the body members of conventional door lock except the latch bar, latch opening/closing mechanism and decorative panel.

As shown in FIG. 1, 2 and 3, the latch body of improved latches 1*a*, 1*b* according to the present invention consists of a base 11, an upper cover 12 and a latch fixing plate 13 which are integrally molded together with aluminum-zinc alloy. A nut cylinder 111 is in a position nearby the rear end of base body 110 of base 11, and a correspondent tap hole 121 is in a position nearby the rear end of the cover body 120 of upper cover 12, so as to dispose a screw 27 in the nut cylinderl 111 on the base body 110 for mutual joint. The shape and structure of plate body 130 of latch fixing plate 13 are the same as those of foregoing latch fixing plate 23 of conventional long and short latches 2*a*, 2*b*; the flat O-shaped hole 131 at the center of the center of the plate body 130 is for a latch bar 24, and one each hole 132 on two sides thereof is designed to install a decorative panel 26.

In addition, the outer sides of front sections of both base body 110 and upper cover body 120 are provided with one each recess 112, 122 while molding, and one each guide track 101 is provided in the recess 112, 122 (not shown in FIG. 3 since the guide track 101 on the base 11 is covered by the base body 110), and one each guide track 101 is provided with a threaded hole 102; two opposite fixing pieces 133 are extended from the back of the plate 130 of latch fixing plate 12 of the improved door lock latch 1 according to the present invention; one each guide way 134 is provided on the inner side of each fixing piece 133 and one each slot 135 is provided in each guide way 134, and meantime, two conical indentations 136 are provided in the position of slots 135 on the outer side of fixing piece 133 so that in any one position of the conical indentation 136, a screw 14 is disposed in the threaded hole 102 on the guide way 101 on the base body 110 or the upper cover body 120 so as to lock and joint the mutually locked and jointed base 11 and upper cover 12 at the rear end thereof with the latch fixing plate 13.

In view of the above, after installing a latch opening/closing mechanism 25 and a latch bar 24 between a base 11 and an cover 12 according to the present invention and locking and jointing the said base 11 and upper cover 12 at the rear end thereof, all of them can be inserted and installed between the two fixing pieces 133 on the back of latch fixing plate 13 whereon a decorative panel 26 is riveted, and one each screw 14 is used to lock both the baser 11 and the upper cover 12 up and down respectively, and then the assembly of an improved long latch 1*a* of door lock (as shown in FIG. 1) or an improved short latch 1*b* of door lock (as shown in FIG. 2) according to the present invention is well finished; furthermore, the long latch of door lock can be optionally changed into a short latch of door lock, and vise versa. While change, all to do is to loosen the screw 14 on each fixing piece 133, to "press" the latch fixing plate 13 of long latch 1*a* onto the locked and jointed base 11 and upper cover 12 as shown in FIG. 1, and dispose and lock the screw 14 in the position of front one conical indentation 136 on the fixing piece 133, then it is an improved short latch 1*b* of door lock according to the present invention as shown in FIG. 2; if to loosen the screw 14 on the fixing piece 133, to "pull" the latch fixing plate 13 of short latch 1*b* of door lock from the locked and jointed base 11 and upper cover 12 as shown in FIG. 2, and to dispose and lock the screw 14 in the position of rear one conical indentation 136 on the fixing piece 133, then it is an improved long latch 1*a* of door lock according to the present invention. It is very simple, convenient and quick to change the short latch into the long latch of the improved door lock and vice versa.

What is claimed is:

1. A improved door lock latch comprising:

a base with a nut cylinder provided nearby a rear end of a base body thereof;

an upper cover with a correspondent tap hole provided nearby a rear end of a cover body thereof; and a latch fixing plate with a flat O-shaped hole for a latch bar at a center of a plate body thereof, and two holes on two sides of the plate body so as to rivet and install a decorative panel on a front of the plate body;

a latch opening/closing mechanism and a latch bar installed between the base and the upper cover, a screw disposed in the tap hole on the upper cover and the nut cylinder of the base so as to lock and join each other;

outer sides of front half sections of the base body as well as the upper cover body being provided respectively with the following members:

a recess, a guide track in each one recess, a threaded hole on each one guide track, two opposite fixing pieces extended from a back of a latch fixing plate body, a guide way on an inner side of each one fixing piece, a slot in each one guide way, and two conical indentations in a position of each one slot on outer sides of the two fixing pieces;

whereby the mutually locked and jointed base and upper cover are installed between the two fixing pieces of the latch fixing plate and locked with one each screw up and down so that an assembly of an improved long or short latch of door lock is finished.

* * * * *